US010744664B2

(12) United States Patent
Adami et al.

(10) Patent No.: US 10,744,664 B2
(45) Date of Patent: Aug. 18, 2020

(54) DEVICE FOR TRANSVERSE CUTTING OF A WEB MATERIAL AND MACHINE CONTAINING SAID DEVICE

(71) Applicant: FOSBER S.P.A., Pescaglia (IT)

(72) Inventors: Mauro Adami, Viareggio (IT); Raffaele Tomelleri, Sommacampagna (IT)

(73) Assignee: Fosber S.p.A., Pescaglia (IT)

( * ) Notice: Subject to any disclaimer, the term of this patent is extended or adjusted under 35 U.S.C. 154(b) by 0 days.

(21) Appl. No.: 15/509,898

(22) PCT Filed: Jul. 31, 2015

(86) PCT No.: PCT/EP2015/067635
§ 371 (c)(1),
(2) Date: Mar. 9, 2017

(87) PCT Pub. No.: WO2016/037764
PCT Pub. Date: Mar. 17, 2016

(65) Prior Publication Data

US 2017/0239830 A1 Aug. 24, 2017

(30) Foreign Application Priority Data

Sep. 10, 2014 (IT) ..... FI2014A0207

(51) Int. Cl.
*B26D 1/40* (2006.01)
*B26D 5/12* (2006.01)
(Continued)

(52) U.S. Cl.
CPC ..... *B26D 1/405* (2013.01); *B26D 1/626* (2013.01); *B26D 5/12* (2013.01); *B26D 7/265* (2013.01);
(Continued)

(58) Field of Classification Search
CPC .. F28D 11/02; F28D 11/04; F28F 5/02; Y10T 83/4795–4847; Y10T 83/483–4844;
(Continued)

(56) References Cited

U.S. PATENT DOCUMENTS 3,076,523 A * 2/1963 Fuller ..... B21B 31/076 184/7.4
3,411,333 A * 11/1968 Frankel ..... B21B 27/08 72/45
(Continued)

FOREIGN PATENT DOCUMENTS

DE 4203497 A1 8/1993
DE 102010027181 A1 1/2012
(Continued)

*Primary Examiner* — Laura M Lee
(74) *Attorney, Agent, or Firm* — Breiner & Breiner, L.L.C.

(57) ABSTRACT

The device includes a hollow cutting roller with a blade attached to the outer surface of the hollow roller. A stationary shaft is also provided, arranged inside the hollow roller and coaxial therewith. The stationary shaft is connected to a supporting structure and the hollow roller is rotatably supported onto the stationary shaft. A motor drive is provided to rotate the hollow roller around the stationary shaft. The hollow roller is supported onto the stationary shaft by at least a hydrostatic bearing arranged in an intermediate position between the ends of the stationary shaft.

28 Claims, 6 Drawing Sheets

(51) Int. Cl.
*B26D 7/26* (2006.01)
*B26D 1/62* (2006.01)

(52) U.S. Cl.
CPC ..... *B26D 1/40* (2013.01); *B26D 1/62* (2013.01); *Y10T 83/4838* (2015.04); *Y10T 83/4844* (2015.04)

(58) Field of Classification Search
CPC ... B26F 1/384; B26F 1/20; B26F 1/44; B26D 7/265; B26D 1/405; B26D 1/626; B26D 1/62; B26D 1/40; B26D 5/12; F16C 13/026; D21G 1/022
USPC ..... 492/46, 60, 16–20, 4–7; 165/89, 90, 165/DIG. 160, DIG. 161; 83/331–349, 83/842–849, 659, 698.42, 663, 100, 112; 384/118
See application file for complete search history.

(56) References Cited

U.S. PATENT DOCUMENTS 3,997,953 A * 12/1976 Christ ..... A45D 1/04 492/2
4,420,999 A 12/1983 Hirakawa et al.
4,548,112 A * 10/1985 Thomas ..... B26D 1/626 83/343
4,574,672 A * 3/1986 Ehm ..... B23D 59/002 83/216
4,756,219 A * 7/1988 Pohl ..... B26D 1/626 83/344
4,805,279 A * 2/1989 Pav ..... D21G 1/022 492/2
5,308,307 A * 5/1994 Morel ..... B21B 27/055 492/1
6,032,558 A * 3/2000 Michler ..... B26D 7/08 101/216
6,230,597 B1 * 5/2001 Baba ..... B26D 7/10 83/171
2008/0314221 A1 * 12/2008 Supe-Dienes ..... B26D 7/2635 83/698.51
2014/0174270 A1 6/2014 DeMarco et al.

FOREIGN PATENT DOCUMENTS

DE 102011108954 A1 1/2013
KR 20110000416 A1 1/2011

* cited by examiner 15
69
67
65
43
25
59
A15
71
D4
D3
23A
23
M1
27
17
39
A17

Fig.6
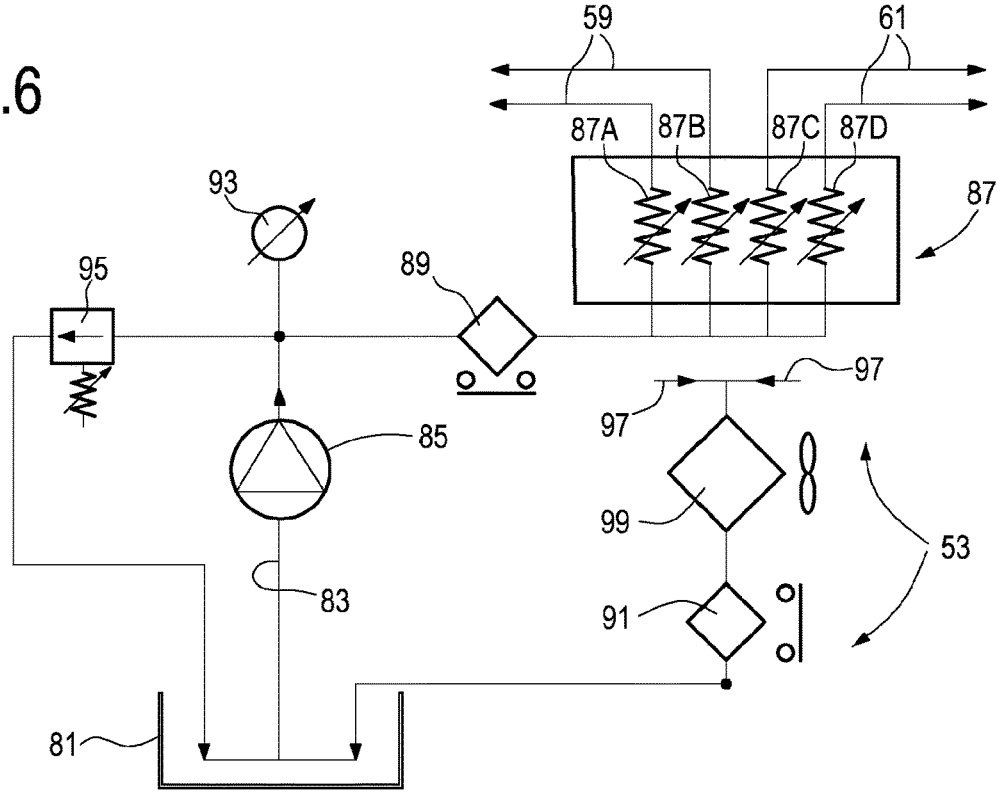
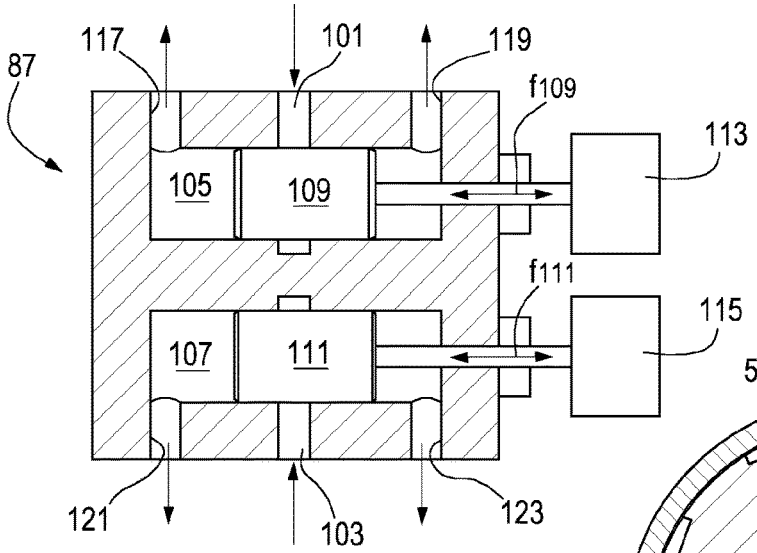
Fig.7
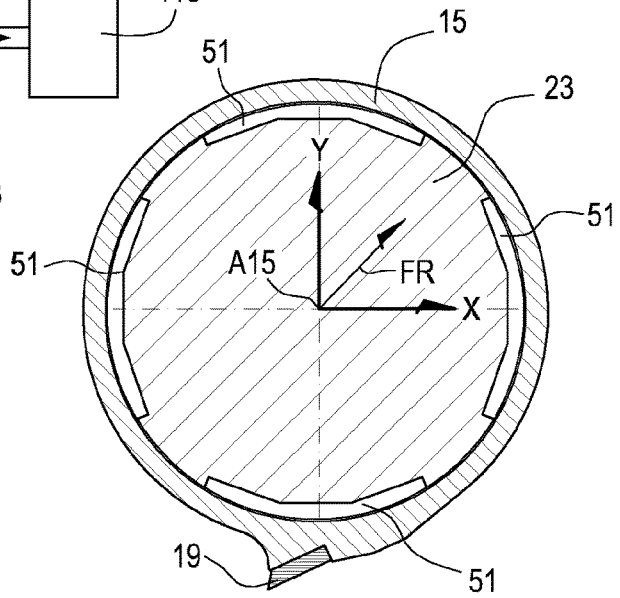
Fig.8

DEVICE FOR TRANSVERSE CUTTING OF A WEB MATERIAL AND MACHINE CONTAINING SAID DEVICE

TECHNICAL FIELD

The present invention relates to devices for transverse cutting of a web material, for instance a cardboard strip, especially, but without limitation, corrugated cardboard, continuously fed along a feeding path.

BACKGROUND ART

In many industrial processes, it is necessary to cut a continuous web material, fed along a feeding path, into single sheets.

This kind of cutting device is typically used in the production of cellulose sheets, for instance sheets of corrugated cardboard.

Corrugated cardboard is produced continuously starting from reels of paper, from which at least three paper sheets are unwound and then glued together. Before being glued, the intermediate sheet is processed by means of a corrugator to form transverse flutes that are glued to the two outer sheets, or webs, forming the so-called liners of the finished corrugated cardboard. The corrugated cardboard can also comprise more than three sheets glued together, arranging corrugated sheets between smooth sheets. The web of corrugated cardboard is transversally cut into individual sheets by means of a so-called shearing machine. The shearing machine usually comprises two opposite cutting devices, each of which includes a roller and a respective blade applied thereto. The two rollers rotate synchronously and the two blades cut the corrugated cardboard into individual sheets, whose length can be defined according to production needs. By changing the speed of rotation of the two rollers of the cutting devices forming the shearing machine, it is possible to produce, in quick succession, individual batches of sheets of different dimensions.

Usually, the roller of each cutting device is hollow and supported onto a stationary shaft, this latter being fastened to two flanks. The stationary shaft comprises a plurality of rolling bearings supporting the hollow roller, onto which the blade is applied, forming the cutting member of the device. In some embodiments, the blade can be parallel to the axis of rotation of the roller. The blade is preferably inclined with respect to the axis of rotation of the roller, i.e. it has a helical shape, so as to gradually cut the corrugated cardboard sheet. In this case, the axes of rotation of the two opposite rollers of the cutting devices forming the shear machine are inclined, with respect to the feeding direction of the web material to be cut, by an angle other than 90°, in order that the cut done by the inclined blades is orthogonal to the feeding direction of the web material.

The cutting rollers are hollow and supported onto a stationary shaft because they are subject to significant acceleration and deceleration dynamic stresses, as they work at a non-constant speed of rotation and can remain stationary for given time intervals. Namely, the cutting rollers rotate at constant speed only when the sheets to be cut have a longitudinal dimension (i.e. in the feeding direction of the cardboard along the feeding path) equal to the circumferential extension of the cutting rollers. In all other cases, i.e. when this dimension is lower or greater than the circumferential extension of the cutting rollers, these latter shall be cyclically accelerated/decelerated in order to synchronize the cutting operations with the feeding movement of the web material, so as to have sheets of the desired length.

More in detail, if the sheets to be cut have a longitudinal dimension greater than the circumferential extension of the cutting rollers, these latter shall slow down or, in some cases, even stop between a cut and the following one. Vice versa, if the sheets to be cut have a longitudinal dimension lower than the circumferential extension of the cutting rollers, these latter shall accelerate between a cut and the following one. Actually, the cut shall be done at a peripheral speed of the cutting rollers, and of the respective blades, equal to the feeding speed of the web material, i.e. of the corrugated cardboard; otherwise, the corrugated cardboard would be damaged by the blades and cut not orthogonally.

The corrugated cardboard is fed along the feeding path at relatively high speed, in the order of 200-400 m/min, for example, and for this reason the accelerations/decelerations to which the cutting rollers are subject are highly significant. It is therefore necessary that the cutting rollers have low inertia; for this reason they are hollow, in order to reduce the moving mass as much as possible.

Cutting the cardboard causes dynamical loads onto the blades, and thus onto the hollow rollers, that are transmitted i onto the respective stationary shaft through the rolling bearings supporting the hollow roller.

In order to accurately cut the sheets and achieve a good quality thereof, it is necessary to reduce the deformations resulting from the dynamic stresses onto the blades, the hollow rollers and the shafts. These deformations can be reduced by increasing the diameter of the stationary shaft and, thus, the diameter of the hollow rollers supported thereon.

There are shear machines provided with roller bearings interposed between the stationary shaft and the hollow cutting roller of each cutting device so as to achieve a greater stiffness. However, due to the sizes of the bearings interposed between stationary shaft and hollow roller, the shaft has a diameter substantially smaller than the diameter of the hollow roller.

There are machines that use cams acting between the hollow roller and the inner stationary shaft in order to adjust, to a certain extent, the deformation to which the shaft and the roller are subject during the cut. This adjustment can be modified only by regulating the cam system again, and this is quite laborious. Moreover, the use of adjustment cams does not limit possible vibrations.

Moreover, the existing shear machines are subject to thermal expansions resulting from the non-uniform heating of the cutting roller, and these thermal expansions can cause cut inaccuracies. The expansions depend on the operating conditions.

There is therefore the need for a cutting device and a shear machine comprising this cutting device, which completely or partly overcome or alleviate the above mentioned drawbacks.

SUMMARY OF THE INVENTION

According to a first aspect, a device is provided for transverse cutting of a continuous web material, comprising a hollow roller with an inner surface, an outer surface and a rotation axis. The hollow roller is provided with at least a blade attached onto the outer surface of the hollow roller. A stationary shaft, with a first end and a second end opposite to each other, is arranged inside the hollow roller and coaxial therewith. The stationary shaft is fastened to a supporting structure and the hollow roller is rotatably supported onto the stationary shaft. A motor drive is provided to rotate the hollow roller around the stationary shaft. Moreover, at least one hydrostatic bearing is provided, arranged in intermediate position between the first and the second end of the stationary shaft. The hydrostatic bearing supports the hollow roller in an intermediate position on the stationary shaft.

Thanks to the use of a central hydrostatic bearing, the difference between the inner diameter of the hollow roller and the outer diameter of the stationary shaft, onto which the hollow roller is supported, is minimal. In this way, given the same outer dimension of the hollow roller, it is possible to optimize the cross section of the stationary shaft and it is therefore also possible to reduce deformations to which the stationary shaft is subject. It is also possible to reduce vibrations in operation, this resulting in a better product and less wears, as well as in reduced noise.

In advantageous embodiments, the hydrostatic bearing includes a plurality of hydrostatic pads, each of which comprises, for instance, a pocket or recess where a bearing fluid, for example oil, is fed. The hydrostatic pads are advantageously arranged around the rotation axis of the hollow roller, preferably according to a constant angular pitch. Each hydrostatic pad can be associated with at least one port for feeding the bearing fluid. The recesses forming the hydrostatic pads can be provided in the cylindrical surface of the stationary shaft.

In other embodiments, a single recess can be provided, instead of a plurality of recesses. The single recess can have a 360° annular extension around the rotation axis of the hollow roller. The single recess essentially forms a single hydrostatic pad. Therein the bearing fluid is fed through one or more ports. The single annular recess can be provided on the cylindrical surface of the stationary shaft. In other embodiments, the single recess can be provided in the inner cylindrical surface of the hollow roller.

Generally speaking, on the side of the recess(es) forming the hydrostatic pad(s), cylindrically extending annular bearing gaps are provided. These gaps are formed between two substantially cylindrical opposite surfaces, one of which being provided on the outer surface of the stationary shaft and the other being provided on the inner surface of the hollow roller. One or the other of these surfaces, or both, can be provided onto a radial projection extending radially outwardly from the outer surface of the stationary shaft, or extending radially inwardly from the inner surface of the hollow roller.

Generally speaking, beyond each annular gap, towards the corresponding end of the stationary shaft, an annular chamber can be provided, into which the bearing fluid flows, passing through the respective gap. Usually, the annular chamber is provided between the inner surface of the hollow roller and the outer surface of the stationary shaft. It can be provided by forming a radially inner annular projection onto the inner surface of the hollow roller, or by forming a radially outer annular projection onto the outer surface of the stationary shaft, or by combining two projections together. What is important is the radial dimension, i.e. the thickness of the chamber shall be preferably greater than the radial dimension of the gap adjacent to the recess(es) forming the hydrostatic pads of the hydrostatic bearing. In this way, the bearing fluid fed under pressure to the recess(es) flows through the gap, thus giving the reaction force for the support of the hollow roller, and reaches the chamber; it is then removed and circulates in an suitable circuit, an exemplary embodiment of which will be described below.

In some embodiments, to achieve an arrangement of recesses or hydrostatic pads as described above, the stationary shaft can have an intermediate or central portion having a diameter greater than the diameter of portions axially adjacent to the central portion. The diameter of the central portion is a few tenths of millimeter smaller than the inner diameter of the hollow roller. In this way a bearing gap is formed. The pockets or recesses are in the form of lowered areas, i.e. in the form cavities of reduced depth, provided in the central portion of increased diameter of the stationary shaft.

In this way, the bearing fluid is fed into the recesses of each hydrostatic pad and is pressured to pass through the gap, exiting the intermediate portion of the stationary shaft and reaching, for instance, two annular cavities provided between the stationary shaft and the inner surface of the hollow roller, at the sides of the intermediate portion of increased diameter. These annular cavities form collection chambers to collect the bearing fluid.

The device can comprise a bearing fluid dispenser, configured to adjust the flow rate of the bearing fluid towards the hydrostatic pads, the dispenser being configured to vary the flow rate of bearing fluid towards at least one hydrostatic pad. In this way, it is possible to generate, on the hollow roller, a thrust having, for instance, a variable intensity and direction, to balance any deformation resulting from the load.

In advantageous embodiments, the device comprises an even number of hydrostatic pads, divided into pairs. Each pair can comprise two hydrostatic pads opposite to each other with respect to the rotation axis of the hollow roller, i.e. substantially arranged at 180° with respect to each other. The bearing fluid dispenser can be configured and controlled to variably distribute the bearing fluid rate towards two opposite hydrostatic pads of at least one pair of hydrostatic pads. For example, four hydrostatic pads can be provided, each of which comprising a pocket or recess with a port for feeding the bearing fluid. The two ports of two hydrostatic pads arranged at 180° with respect to each other allow to generate a force, which is orthogonal to the axis of the hollow roller and is represented by a vector, whose magnitude and direction can be adjusted by means of the dispenser, controlling the bearing fluid flow rate towards the four recesses.

In some embodiments, collection ports can be provided along the stationary shaft, to collect the bearing fluid exiting the hydrostatic pad. The collection ports can be fluidly coupled to removal ducts for removing bearing fluid, which are provided for instance inside the stationary shaft and extend towards at least one of the first end and second end of the stationary shaft.

The hollow roller is supported so as to rotate onto the stationary shaft by means of two further end bearings. These bearings can be hydrostatic bearings. However, in some embodiments rolling bearings can be used, i.e. bearings wherein rolling elements, such as balls or rollers, reduce the friction resisting the rotation of the hollow roller around the stationary shaft.

The use of rolling bearings instead of hydrostatic bearings can be advantageous, as it allows the hollow roller to remain in fixed position with respect to the stationary shaft even when there is no motion and the bearing fluid is not fed.

In advantageous embodiments, the set comprised of hollow roller and support shaft can be configured so that the bearing fluid also lubricates the end rolling bearings.

The hollow roller can be motorized by means of a single motor or two motors, one at each end.

In some embodiments, the cutting device can comprise a single hollow roller that carries a blade and rotates around the inner stationary shaft. The rotating blade can co-act with a stationary blade or a counter-blade. In other embodiments, the cutting machine comprises two cutting devices of the type described above; they can be substantially symmetrical with respect to each other and rotate synchronously in opposite directions. In this case, the motor drive can comprise from one to four suitably arranged motors. Toothed wheels at the end of each hollow roller mesh with one another to control the rotation of the two hollow rollers.

According to a further aspect, a processing line is provided to process a web material, comprising at least one cutting device or one cutting machine as described above.

Features and embodiments are disclosed here below and are further set forth in the appended claims, which form an integral part of the present description. The above brief description sets forth features of the various embodiments of the present invention in order that the detailed description that follows may be better understood and in order that the present contributions to the art may be better appreciated. There are, of course, other features of the invention that will be described hereinafter and which will be set forth in the appended claims. In this respect, before explaining several embodiments of the invention in details, it is understood that the various embodiments of the invention are not limited in their application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which the disclosure is based, may readily be utilized as a basis for designing other structures, methods, and/or systems for carrying out the several purposes of the present invention. It is important, therefore, that the claims be regarded as including such equivalent constructions insofar as they do not depart from

BRIEF DESCRIPTION OF THE DRAWINGS

The invention will be better understood by following the description and accompanying drawing, which shows non-limiting practical embodiments of the invention. More particularly, in the drawing:

FIG. 6 shows a diagram of the hydraulic circuit feeding the bearing fluid to the hydrostatic bearing interposed between stationary central shaft and hollow cutting roller of the cutting device;

FIG. 7 shows an adjustment system to regulate the hydrostatic thrust exerted by the hydrostatic bearing used in the device according to the invention; and FIG. 8 is a diagram schematically showing the operation of the device of FIG. 7.

DETAILED DESCRIPTION OF EMBODIMENTS OF THE INVENTION

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

Figure 1:
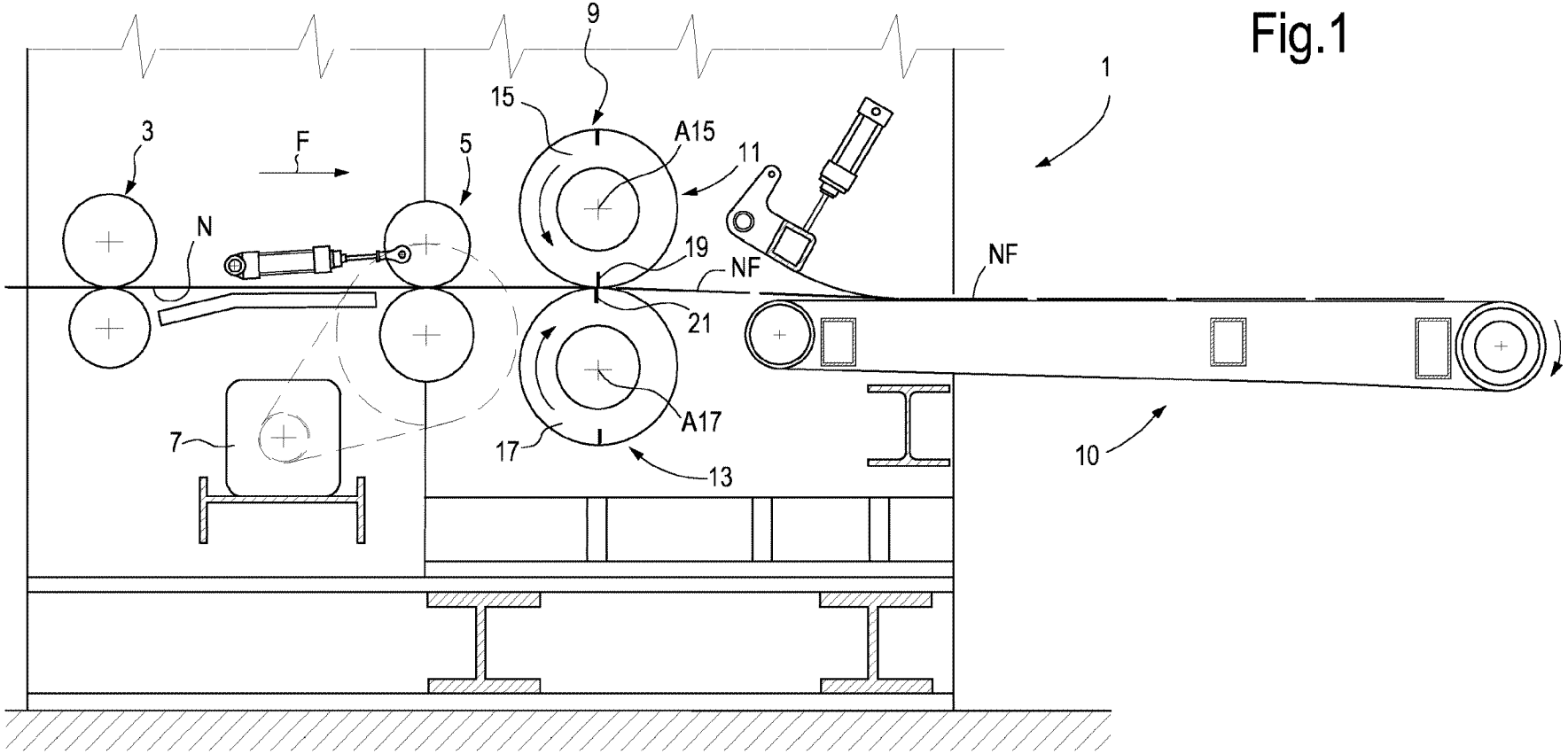
FIG. 1 is a schematic side view of a portion of a processing line for a continuous corrugated cardboard web, limited to the area where the cutting machine is arranged for cutting the cardboard web into single sheets.

FIG. 1 schematically illustrates a portion of a processing line for a continuous web material, typically a web of corrugated cardboard. More specifically, the portion illustrated in FIG. 1 comprises the area where a cutting machine, which divides the continuous web material into sheets is arranged. The present invention can apply to the cut of continuous web materials other than corrugated cardboard, every time there are similar needs regarding the cutting machine subdividing the continuous web into single sheets. Even if the description specifically refers to the processing of corrugated cardboard, however it should be understood that it can also be applied to different technical fields.

In FIG. 1, the processing line is indicated, as a whole, with number 1; N indicates the continuous web material, i.e. the corrugated cardboard web fed along a feeding path according to the arrow F. A pair of feeding rollers 5 are provided along the processing line 1; if necessary, an additional pair of feeding rollers 3 can be provided. Number 7 indicates a motor for actuating the feeding rollers 3 and 5.

A cutting machine 9 is also arranged along the processing line 1; this cutting machine divides the continuous web material N into single sheets NF, which are then fed to a conveyor 10 to be further processed, for instance to be put one over the other to form sheet piles, in a known and therefore not described manner.

The cutting machine 9 comprises two cutting devices 11 and 13, substantially equal to each other, each of which comprises a respective hollow cutting roller 15, 17. The hollow cutting rollers 15 and 17 have an inner surface and an outer surface. A respective cutting blade 19 and 21 is applied on the outer surface of each cutting roller. The cutting blades 19, 21 can be arranged parallel to the rotation axes A15 and A17 of the hollow cutting rollers 15 and 17, respectively. In other embodiments, the blades 19 and 21 can be arranged in helical fashion, inclined at a small angle, for instance from about 1° to about 5°, with respect to the rotation axes A15, A17, so as to cut gradually the continuous web material N. In this case the hollow cutting rollers 15 and 17 are arranged slightly inclined, i.e. not orthogonal to the feeding direction of the web material N along the feeding path, in order that the continuous web material N is cut into individual sheets NF according to lines orthogonal to the feeding direction, and, thus, to the longitudinal edges of the continuous web material N.

Figure 2:
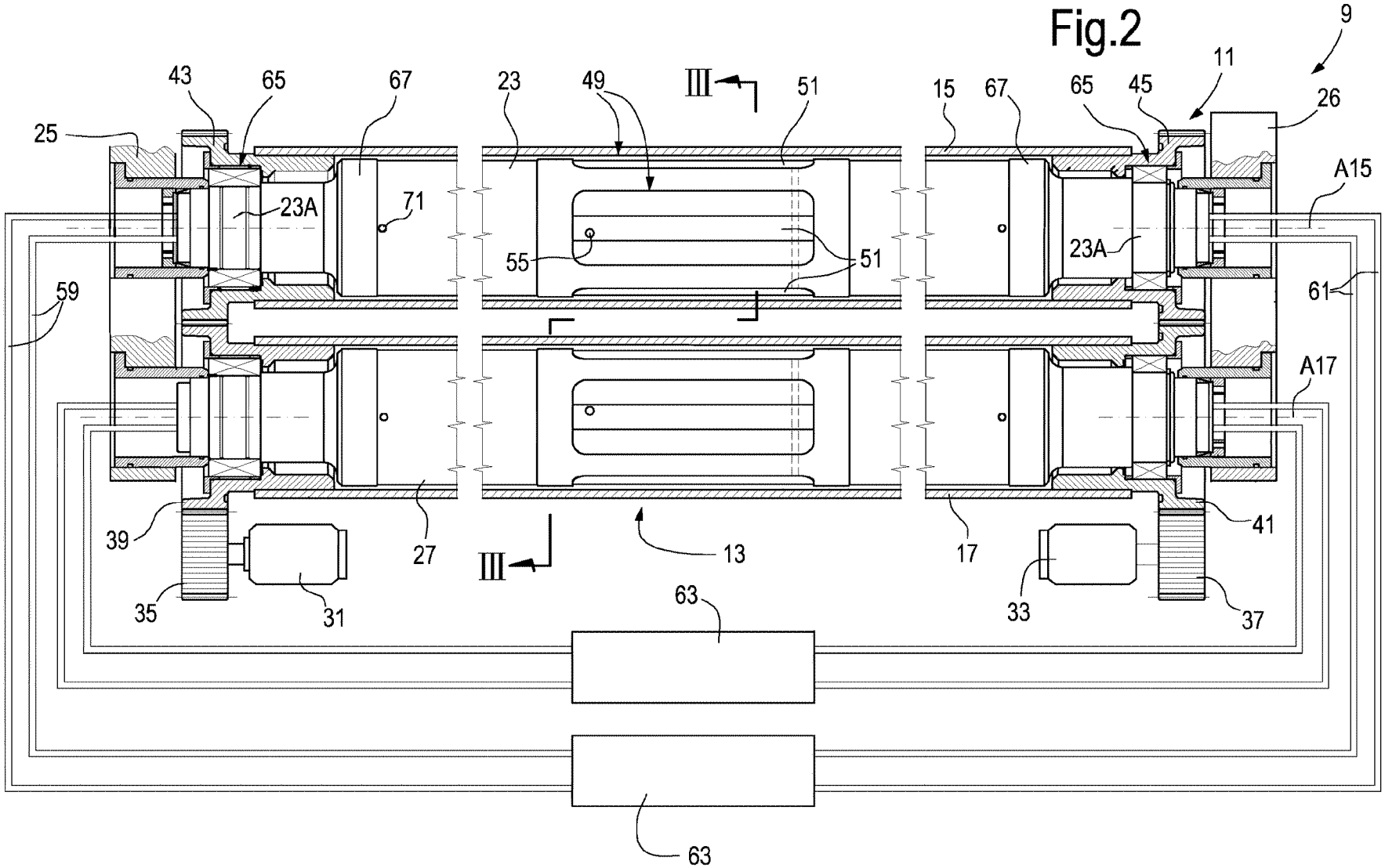
FIG. 2 shows a section according to a plane containing the axes of rotation of the cutting rollers of a cutting machine that can be used in the installation of FIG. 1.
Figure 3:
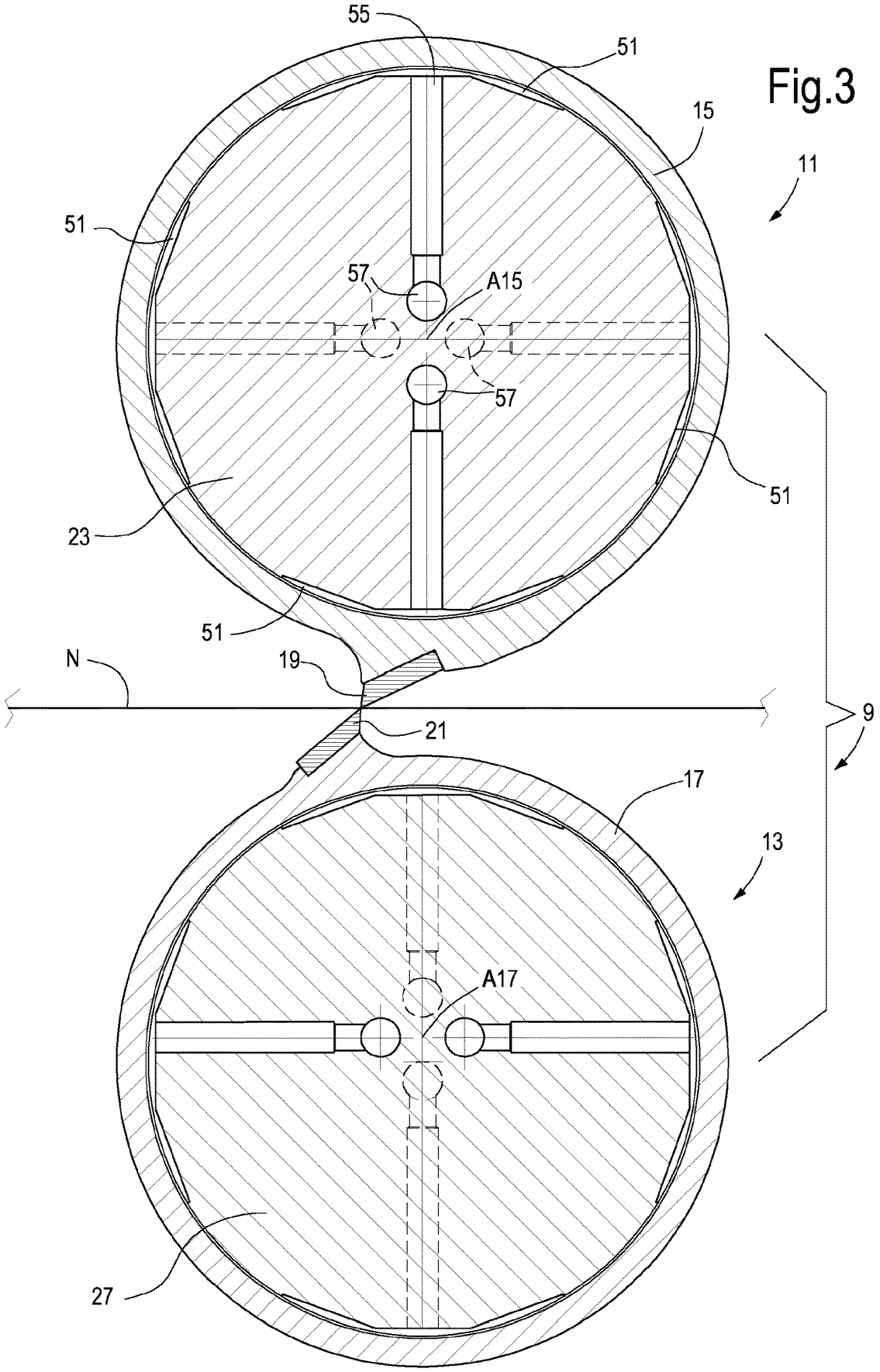
FIG. 3 is a cross-section according to III-III of FIG. 2.

FIGS. 2 and 3 illustrate in greater detail the general features of the cutting machine 9. The hollow cutting roller 15 is supported so as to rotate around its rotation axis onto a inner stationary shaft 23, mounted on a stationary structure of the cutting machine 9, for instance on two flanks 25 and 26. Similarly, the hollow cutting roller 17 is supported so as to rotate around its rotation axis onto an inner stationary shaft 27, mounted onto the flanks 25 and 26.

Thus, each cutting device 11, 13 comprises a rotating part (hollow cutting roller 15, hollow cutting roller 17) of reduced mass, supported by the respective stationary shaft 23, 27. This allows the hollow cutting rollers 15, 17 to be subject to high cyclical accelerations and decelerations, due to the reasons described above. One or more actuators, for instance electronically controlled electric motors, rotate the hollow cutting rollers 15, 17.

Two motors 31 and 33 are shown in FIG. 2 just by way of example, arranged at the two ends of the hollow cutting rollers 15, 17. The rotation of the two motors 31, 33 is a synchronous motion, transferred, by means of respective pinions 35, 37, to toothed wheels 39, 41 torsionally coupled to the hollow cutting roller 17. The toothed wheels 39, 41 mesh with respective toothed wheels 43, 45, rigidly torsionally coupled to the hollow cutting roller 15, so that this latter rotates synchronously with the hollow cutting roller 17, but in the opposite direction.

In other embodiments, a single motor 31 or two motors can be provided, one of which is associated with the hollow cutting roller 15 and the other one is associated with the hollow cutting roller 17. In further embodiments, four motors can be provided, each of which transmits motion, by means of a respective pinion, to a respective one of the four toothed wheels 39, 41, 43, and 45.

The hollow cutting roller 15 can be supported onto the respective stationary shaft 23 by means of a bearing system, comprising at least one hydrostatic bearing. The hydrostatic bearing is arranged in the central area of the hollow cutting roller 15 and the respective stationary shaft 23. The hydrostatic bearing is indicated as a whole with number 49, and in the illustrated embodiment comprises a plurality of recesses provided in the surface of the stationary shaft 23. The recesses are indicated with number 51 and are specifically visible in the cross section of FIG. 3. In the illustrated embodiment, four recesses or pockets 51 are provided, distributed uniformly accordingly to a 90° angular pitch, around the rotation axis A15 of the hollow cutting roller 15. In other embodiments, a different number of recesses or pockets 51 may be provided, for instance a single pocket 51 or, preferably, three or more recesses or pockets 51. The use of four recesses 51 has particular functional advantages for the operation of the cutting machine 9, as it will be clear later on.

In the illustrated example, the recesses 51 are in the form of cavities provided in the outer surface of the stationary shafted 23 and are open towards the inner surface of the hollow cutting roller 15. In other embodiments, the recess(es) can be in the form of cavities provided in the inner surface of the hollow cutting roller 15 and are open towards the stationary shaft 23. In this case only one annular recess is preferably provided, extending for instance for 360° around the rotation axis of the hollow cutting roller 15.

In the illustrated example, the recesses 51 are provided in a central area or portion 53 of the stationary shaft 23.

In further embodiments, not shown, where the recesses 51 are provided on the inner surface 15S of the hollow cutting roller 15, the feeding port can be preferably provided on the stationary shaft 23, in order that the bearing fluid is fed in an easier way. Alternatively, the ports for feeding the bearing fluid can be arranged on the hollow cutting roller 15, for instance providing a rotating dispenser for dispensing bearing fluid towards the hollow cutting roller 15.

In some embodiments, only one annular recess can be provided on the inner surface of the hollow cutting roller 15; in this case one or more ports for feeding the bearing fluid can be provided on the stationary shaft 23.

Figure 4:
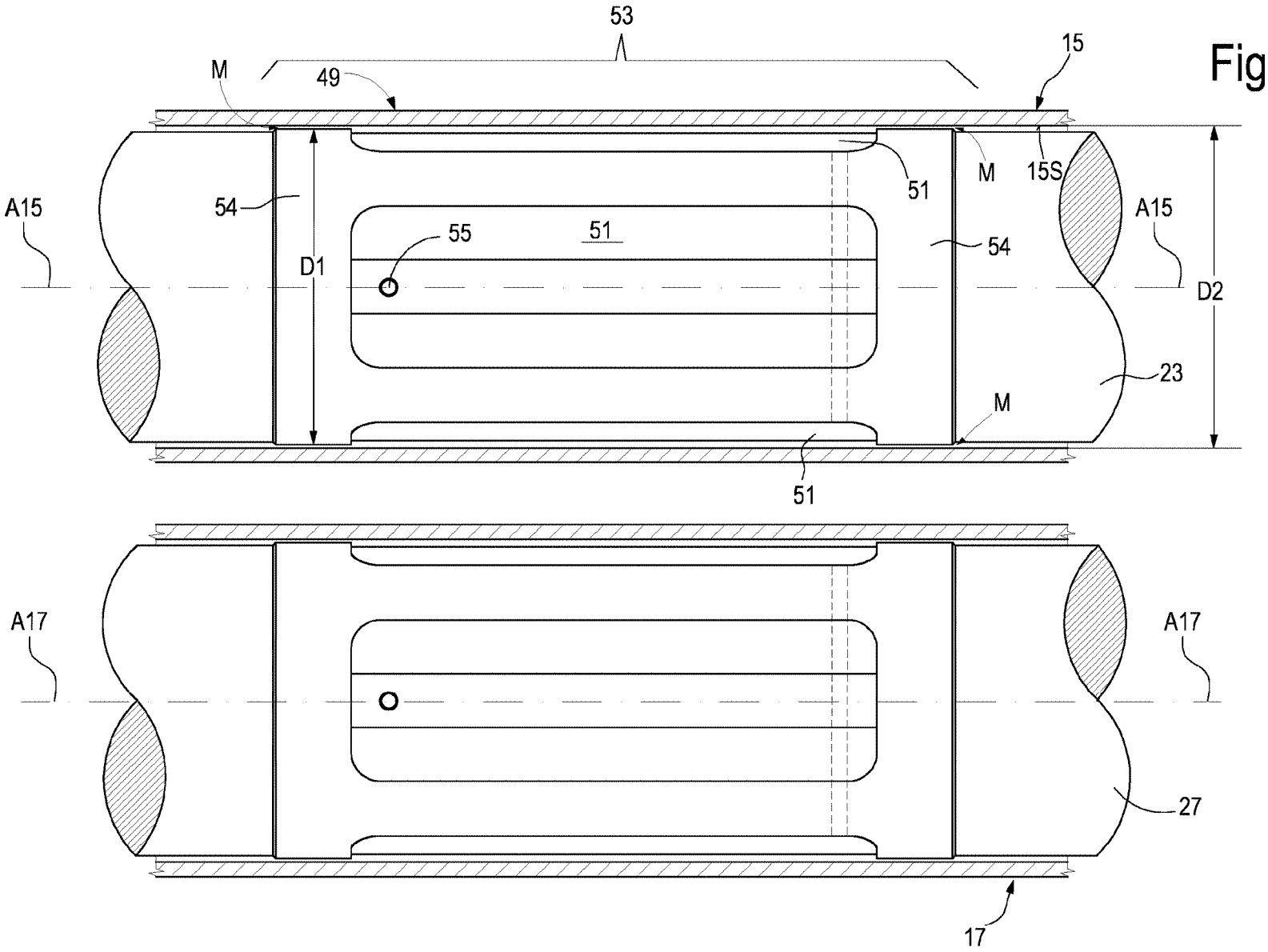
FIG. 4 is an enlarged detail of the central portion of FIG. 2.

In the illustrated embodiment, the central area or portion 53 has a diameter D1 slightly smaller than the inner diameter D2 of the sleeve forming the hollow cutting roller 15. The difference between the diameter D2 and the diameter D1 defines a cylindrical gap M between the portion 53 of the stationary shaft 23 and the inner cylindrical surface, indicated with 15S (FIG. 4), of the sleeve forming the main body of the hollow cutting roller 15. Essentially, the recesses or pockets 51 are arranged between two annular projections 54 provided in the central area 53 of the stationary shaft 23, that, having a diameter D1, form hydrostatic bearing gaps M between the outer cylindrical surface of the projection 54 and the cylindrical surface 15S of the sleeve forming the main body of the hollow cutting roller 15. The recesses 51 form hydrostatic pads fed with a bearing fluid, typically oil, through at least one feeding port 55 for each recess 51. Then, the bearing fluid flows through the hydrostatic bearing gaps M, thus generating a hydrostatic bearing force of the hollow cutting roller on the inner stationary shaft.

In the illustrated embodiment, the gaps M are provided between a continuous cylindrical surface of the hollow cutting roller 15 and an area or portion 53 of increased diameter of the stationary shaft 23. The diameter D4 of the stationary shaft outside the portion or area 53 is smaller than the diameter D1. It is also possible to form the gaps M in a different manner; for example, the diameter of the stationary shaft 23 can be constant (except for the ends thereof, where further mechanical members are provided, i.e. end bearings, described below), while two radially inner annular projections can be provided, extending from the surface 15S of the hollow cutting roller 15. What is important is only the presence of two annular gaps M adjacent to the recess(es) 51 (provided on the stationary shaft 23 and/or on the hollow cutting roller 15), in order to generate a pressurized bearing fluid flow from the recess(es) towards the ends of the stationary shaft 23.

An annular collection chamber can be provided outside each gap, towards the respective end of the stationary shaft 23, to collect the bearing fluid, this chamber being formed by the difference between the diameter of the hollow cutting roller 15 and the diameter of the stationary shaft 23, as better described below.

In the illustrated example, the four bearing fluid feeding ports 55 are fluidly coupled to feeding ducts 57 (see in particular FIG. 3) provided along the inner part of the stationary shaft 23. In some embodiments, two of the feeding ducts 57 extend from the hydrostatic pad 49 towards one end of the stationary shaft 23, while the other two ducts 57 extend towards the other end of the same shaft 23. The four bearing fluid feeding ducts 57 can be connected, by means of tubes 59 and 61 (see FIG. 2) to a bearing fluid dispenser, which comprises, for example, a hydraulic unit schematically indicated with number 63 in FIG. 2 and illustrated in greater detail in FIGS. 6 and 7.

In some embodiments, more than one hydrostatic bearing can be provided along the longitudinal extension of the hollow cutting roller 15. However, in currently preferred embodiments of the invention, only one hydrostatic bearing 49 is provided in intermediate and approximately central position of the hollow cutting roller 15, in order to simplify the structure of the cutting device 9, reduce the cost thereof, facilitate the control of the fed bearing fluid, and reduce the complexity of the bearing fluid feeding systems.

The ends of the hollow roller 15 can be supported onto the stationary shaft 23 by means of side hydrostatic bearings. In the illustrated embodiment, the end support of the hollow cutting roller 15 onto the stationary shaft 23 is obtained by means of respective end bearings 65. Advantageously, these end bearings 65 are rolling bearings. They can be, for instance, ball bearings or roller bearings.

Figure 5:
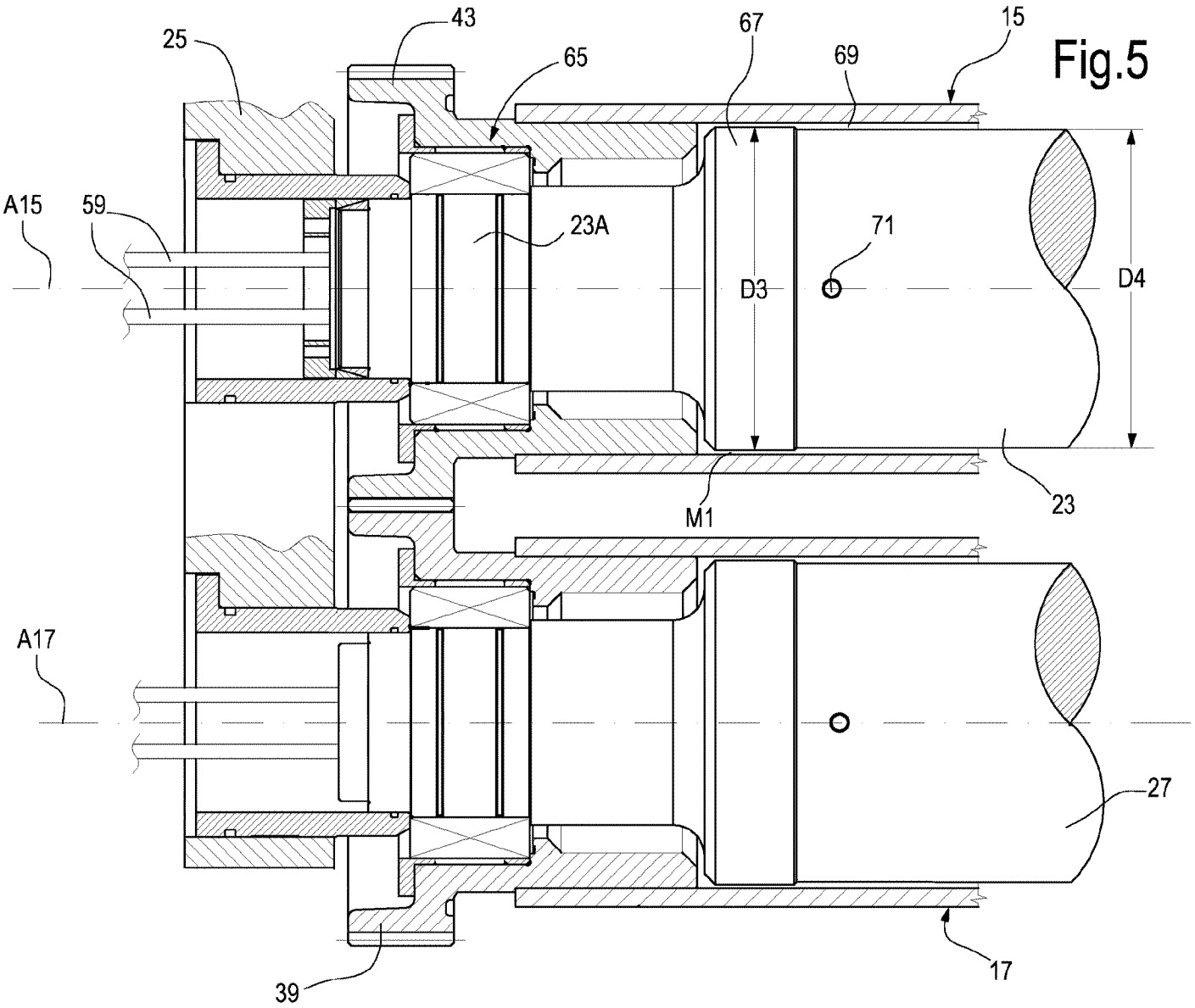
FIG. 5 is an enlargement of an end part of the hollow cutting rollers of FIG. 2.

In some embodiments, the rolling bearings 65 can be mounted inside the toothed wheels 43 and 45. The inner race of each rolling bearing 65 is mounted on respective end shanks 23A of the stationary shaft 23, see in particular FIG. 5. The diameter of the shanks 23A can be smaller than the diameter D1, so that the rolling bearings 65 can be housed between the stationary shaft and the respective hollow cutting roller. In fact, these end shanks 23A are subject to less stresses, as they are arranged adjacent to the support flanks 25, 26; thus, their reduced diameter does not affect the deformation resistance of the set formed by the hollow cutting roller 15 and the respective stationary shaft 23.

The stationary shaft 23 can have annular projections 67 (see in particular FIG. 5) having a diameter D3, adjacent to each end shank 23A. The diameter D3 can be equal to the diameter D1 of the annular projections forming the hydrostatic gaps M of the hydrostatic bearing 49 described above. In this way, a second gap M1 is defined between each annular projection 67 and the inner surface 15S of the sleeve forming the main body of the hollow cutting roller 15. The gaps M1 provided in the area near the ends of the shaft 23 are reduction gaps for reducing the bearing fluid flow rate from the central area of the stationary shaft 23 towards the rolling bearings 65 arranged on the ends thereof. A respective annular chamber 69 is provided between the intermediate area or portion 53 of the stationary shaft 23 and each annular projection 67; the radial dimension of this chamber is given by the difference between the diameter D2 of the inner cylindrical surface 15S of the sleeve forming the main body of the hollow cutting roller 15 and a diameter D4, smaller than D1 and smaller than D3, of the portion of stationary shaft 23 that extends between the hydrostatic bearing 49 and one and the other of the two annular projections 67. The annular chambers 69 collect the bearing fluid flowing through the gaps M. In other embodiments, the annular chambers 69 can be formed by providing the inner surface 15S of the hollow cutting roller 15 with portions of greater inner diameter.

In advantageous embodiments, each annular chamber 69 in fluidly coupled to a collection port 71 for collecting the bearing fluid flowing through the hydrostatic gap M towards the respective end of the stationary shaft 23. Part of the bearing fluid flow rate fed through the feeding ports 55 to the hydrostatic pads formed by the pockets or recesses 51 is collected by the collection ports 71 and conveyed towards a discharge or removal duct, not shown, for removing the bearing fluid. Part of the bearing fluid flow rate, which flows through the hydrostatic gaps M towards the ends of the stationary shaft 23 and is not removed through the collection ports 71, flows through the flow rate reduction gaps M1 and wets the rolling bearings 65 provided at the ends of the stationary shaft 23. In this way, the rolling bearings 65 are lubricated by means of the same bearing fluid used for the operation of the intermediate hydrostatic bearing 49.

The use of ball, roller, or similar rolling bearings 65 at the ends of the stationary shaft 23 and of the hollow cutting roller 15 allows to keep the hollow cutting roller 15 in a defined position, preferably coaxial with the stationary shaft 23, even when the hydrostatic pad 49 does not operate, for instance when the recesses 51 are not fed with bearing fluid.

The cutting device 13 comprising the hollow cutting roller 17 and the stationary shaft 27 is substantially made in the same way as the device 11; therefore, it will be not described hereunder in detail.

With the arrangement described above a cutting machine is provided, wherein the diameter of the inner stationary shaft 23, 27 is equal to, or greater than, D4, with the exception of the end shanks (23A for the stationary shaft 23). The difference between the diameter D4 and the diameter D2 of the inner cylindrical surface 15S of the hollow roller 15 and, similarly, of the hollow roller 17, can be of few millimeters, for instance in the order of 2-5 mm. This dimensional difference is that strictly necessary to form the gaps M ad M1 and collection chambers 69 for the bearing fluid. In this way, the advantage is obtained of having a stationary shaft 23 with a cross section that is maximized with respect to the outer diameter of the corresponding hollow cutting roller 15, 17. This gives the cutting machine 9 high stiffness and reduces the static deformations and vibrations thereof, with consequent advantages in terms of regularity in operation, noise and wear reduction, and increase in the quality of the product manufactured by cutting the continuous web material N.

The use of a central hydrostatic bearing allows further advantages, and offers the possibility of implementing additional functions, as it will be described below.

The feeding of the bearing fluid, typically oil, to the intermediate hydrostatic bearings of the two cutting devices 11, 13 is ensured by means of a common hydraulic unit for the two cutting devices, or by means of two substantially identical hydraulic units. FIG. 2 shows an arrangement with two hydraulic units, schematically indicated with number 63. These hydraulic units 63 can comprise, or be associated with, bearing fluid cooling systems. In this way, it is possible to control the temperature of the two cutting devices 11, 13, and, thus, the thermal expansions of both the hollow cutting rollers 15, 17 and the stationary shafts 23, 27. Particularly, thanks to the arrangement described above, the substantially continuous flow of bearing fluid, from the central area 53 of the stationary shaft 23, 27 towards the ends thereof, allows to remove heat from substantially the entire longitudinal extension of the cutting devices 11, 13. It is therefore possible to control the thermal expansions and the consequent deformations of the mechanical members forming the cutting devices 11, 13. This furthermore contributes to the regular operation, to the stress and wear reduction, as well as to the quality of the finished product obtained by cutting with the cutting machine 9 configured in this way. Moreover, the operation of the cutting machine depends less on its thermal conditions. For example, the differences are reduced between the cutting machine operation at start-up and under steady-state conditions, i.e. when the cutting machine has achieved the final operation temperature.

The use of a hydrostatic bearing 49 with a plurality of hydrostatic pads, each of which comprises a respective recess 51 and at least one bearing fluid feeding port 55, has the further advantage of adjusting any deflection of the stationary shaft 23, 27 and of the corresponding hollow cutting roller 15, 17. In fact, it is possible to adjust the bearing fluid flow rate towards the pockets or recesses 51 by means of a suitable regulator described below with reference to FIGS. 6 and 7, so as to have a controlled counter-deformation of the stationary shaft 23, 27.

FIG. 6 schematically shows one of the hydraulic units 63. This unit can comprise a bearing fluid tank 81, typically oil, from which a pump 85 pumps, through a duct 83, the bearing fluid towards the tubes 59, 61 described above. Number 87 schematically indicates, as a whole, a flow-rate controller, a diagram of which is shown in FIG. 7 and which will be described in greater detail below. Numbers 89 and 91 indicate suitable filters that can be provided in several positions of the hydraulic circuit. Number 93 indicates a pressure switch, and number 95 indicates a pressure control valve, through which a bearing fluid flow rate can be re-circulated towards the tank 81, in order to keep a constant delivery pressure of the pump 85 towards the controller 87.

In the diagram of FIG. 6, the controller 87 is illustrated comprising four valves 87A, 87B, 87C and 87D, each of which is combined with one of the tubes 59, 61. Through the valves 87A-87D it is possible to adjust the bearing fluid flow rate towards the single hydrostatic pads comprising the recesses 51, for the purposes better described with reference to FIGS. 7 and 8.

Number 97 indicates bearing fluid recovery tubes, fluidly coupled to the collection ports 71. The bearing fluid flow rate recovered through the collection ports 71 is conveyed, through the tubes 97, to a heat exchanger 99, for example an oil/air exchanger. In heat exchanger 99, heat is removed from the bearing fluid; the exchanger therefore performs a cooling and thermostatic function for the respective cutting device 11, 13.

In the embodiments of FIG. 7, the controller 87 comprises two inlets 101 and 103, through which the bearing fluid flow rate, generated by the pump 85, is fed inside the controller 87. This latter comprises two adjusting chambers 105 and 107. The chamber 105 is fluidly coupled to the inlet 101, and the chamber 107 is fluidly coupled to the inlet 103. In the chamber 105, which can extend cylindrically, a slider can be housed, in the form of a piston 109. Similarly, in the chamber 107 a slider can be housed, in the form of a piston 111.

By means of actuators 113 and 115, for instance, the two sliders 109 and 111 can translate according to the double arrows indicated in FIG. 7.

The diameter size of each slider 109, 111 and the diameter size of the respective chambers 105, 107 are slightly different from each other, in order to form a gap between the outer surface of each slider 109, 111 and the inner surface of the chamber 105 and the chamber 107, respectively. The chamber 105 is fluidly coupled to a pair of outlets 117, 119. Similarly, the chamber 107 is fluidly coupled to outlets 121 and 123. The outlets 117, 119 can be fluidly coupled, through anyone of the tubes 59, 61, to two opposite recesses or pockets 51, arranged at 180° around the axis A15 or A11 of the respective hollow cutting roller 15, 17. Vice versa the outlets 121, 123 are fluidly coupled, through the other two tubes, to the two remaining opposite recesses 51.

As regards the chamber 105, thanks to the gap formed between the outer surface of the slider 109 and the inner surface of this chamber 105, the bearing fluid flows from the inlet 101 towards the two outlets 117, 119. By modifying the position of the slider 109 by means of the actuator 113 (double arrow f109 in FIG. 7) it is possible to change the flow resistance of the bearing fluid flow rate directed from the inlet 101 respectively towards the outlet 117 and the outlet 119. In this way, for example by moving the slider 109 to the left in the drawing, it is possible to increase the flow resistance towards the outlet 117 and, at the same time, to reduce the flow resistance towards the outlet 119. This movement of the slider 109 to the left, according to the arrow f109, i.e. towards the outlet 117, causes a reduction in the bearing fluid flow rate through the outlet 117 and an increase in the bearing fluid flow rate through the outlet 119. As mentioned above, these two outlets 117, 119 are fluidly coupled to two recesses 51 arranged at an angle of 180° with respect to each other; for this reason, the controlled displacement of the slider 109 allows to modify the flow rate fed to the two opposite recesses 51. The slider 111 sliding in the chamber 107 works in a similar way, to divide differently the bearing fluid flow rate through the two outlets 121, 123 towards the two remaining recesses 51 arranged at at an angle of 180° with respect to each other and shifted by 90° with respect to the recesses 51 connected to the chamber 105.

In view of the above description, and now with reference to FIG. 8, assuming that the two upper and lower recesses 51 are connected to the outlets 117, 119, and that the two side recesses (on the right side and on the left side in the drawing) are connected to the outlets 121, 123, it is clearly apparent that, using the actuators 113, 115, it is possible to change the flow rates to the various recesses and it is therefore possible to generate variable thrusts according to an X direction and a Y direction. By suitably controlling the actuators 113, 115, it is therefore possible to apply to the hollow cutting roller 15 (and, similarly, to the hollow cutting roller 17) a force resulting from the hydrostatic thrust, schematically indicated with FR in FIG. 8, whose direction around the axis A15 and whose magnitude can be changed by acting on the sliders 109 and 111 by means of the actuators 113, 115.

The controller regulator 87 essentially allows generating a radial thrust FR, whose magnitude and direction around the axis A15 of rotation can be controlled. This force FR can correct deflections of the hollow cutting roller 15.

This can similarly apply to the hydraulic unit 63 and the respective controller 87 associated with the cutting device 13 comprising the stationary shaft 27 and the hollow cutting roller 17.

The embodiments described above and illustrated in the drawings have been explained in detail as examples of embodiment of the invention. It will be clearly apparent to those skilled in the art that modifications, variants, additions and omissions are possible, without however departing from the principles, the scope of the concept and the teachings of the present invention as defined in the attached claims. The scope of the invention shall be therefore determined exclusively based upon the widest interpretation of the attached claims, wherein these modifications, variants, additions and omissions are included within this scope. The terms "comprising" "to comprise" and the like do not exclude the presence of further elements or steps in addition to those specifically listed in a claim. The term "a" or "an" before an element, means or feature of a claim does not exclude the presence of a plurality of these elements, means or features. If a claim of a device claims a plurality of "means", some or all these "means" can be actuated by a single component, member or structure. The enunciation of given elements, features or means in distinct depending claims does not exclude the possibility of combining said elements, features or means together. When a method claim lists a sequence of steps, the sequence with which these steps are listed is not binding and can be changed, if the particular sequence is not indicated as binding. Any reference numerals in the appended claims are provided to facilitate reading of the claims with reference to the description and to the drawing, and do not limit the scope of protection represented by the claims.

The invention claimed is:

1. A device for transverse cutting of a continuous web material, comprising:

a hollow roller with an inner surface, an outer surface and a rotation axis;

a blade attached to the outer surface of the hollow roller;

a stationary shaft with an outer surface, wherein the stationary shaft is arranged inside the hollow roller and is coaxial therewith, the stationary shaft having a first end and a second end, the stationary shaft being connected to a supporting structure, the hollow roller rotatably supported on the stationary shaft;

a motor drive to rotate the hollow roller around the stationary shaft;

at least one hydrostatic bearing comprising one or more recesses in the outer surface of the stationary shaft or in the inner surface of the hollow roller, and arranged in an intermediate position between the first end and the second end of the stationary shaft.

2. The device according to claim 1, wherein each of said one or more recesses is provided with at least one feeding port for a pressurized bearing fluid.

3. The device according to claim 2, wherein the pressurized bearing fluid is fed through the at least one feeding port into each of the one or more recesses.

4. The device according to claim 3, wherein each of said one or more recesses is formed in the outer surface of the stationary shaft and is open towards the inner surface of the hollow roller.

5. The device according to claim 2, wherein the at least one hydrostatic bearing comprises four recesses arranged circumferentially around the rotation axis of the hollow roller.

6. The device according to claim 3, wherein the at least one hydrostatic bearing comprises four recesses arranged circumferentially around the rotation axis of the hollow roller.

7. The device according to claim 2, further comprising a bearing fluid dispenser, to adjust flow rate of the bearing fluid towards the one or more recesses, the dispenser being configured to vary the flow rate of the bearing fluid towards said one or more recesses.

8. The device according to claim 3, further comprising a bearing fluid dispenser, to adjust flow rate of the bearing fluid towards the one or more recesses, the dispenser being configured to vary the flow rate of the bearing fluid towards said one or more recesses.

9. The device according to claim 7, wherein the at least one hydrostatic bearing comprises an even number of said recesses, subdivided into pairs, each one of said pairs comprising two recesses opposite to each other with respect to the rotation axis of the hollow roller, and wherein the bearing fluid dispenser is adapted to distribute in a variable way the flow rate of the bearing fluid towards the two opposite recesses of at least one of said pairs of recesses.

10. The device according to claim 8, wherein the at least one hydrostatic bearing comprises an even number of said recesses, subdivided into pairs, each one of said pairs comprising two recesses opposite to each other with respect to the rotation axis of the hollow roller, and wherein the bearing fluid dispenser is adapted to distribute in a variable way the flow rate of the bearing fluid towards the two opposite recesses of at least one of said pairs of recesses.

11. The device according to claim 2, wherein the one or more recesses are arranged between two annular projections of the stationary shaft defining, with the inner surface of the hollow roller, respective hydrostatic gaps for the bearing fluid to pass towards the first end and the second end of the stationary shaft.

12. The device according to claim 3, wherein the one or more recesses are arranged between two annular projections of the stationary shaft defining, with the inner surface of the hollow roller, respective hydrostatic gaps for the bearing fluid to pass towards the first end and the second end of the stationary shaft.

13. The device according to claim 1, wherein the at least one hydrostatic bearing is arranged in a substantially central position along an extension of the hollow roller.

14. The device according to claim 1, further comprising collection ports along the stationary shaft for collecting the bearing fluid exiting the hydrostatic bearing, the collection ports being fluidly coupled to bearing fluid removal ducts provided inside the stationary shaft and extending towards at least one of said first end and said second end of the stationary shaft.

15. The device according to claim 1, further comprising end bearings arranged at the first end and the second end of the stationary shaft to support the hollow roller on the stationary shaft.

16. The device according to claim 15, wherein the end bearings are rolling bearings.

17. The device according to claim 16, wherein the rolling bearings are lubricated with the bearing fluid fed to the hydrostatic bearing.

18. The device according to claim 17, further comprising reduction gaps associated with the rolling bearings to reduce flow rate of the bearing fluid from the hydrostatic bearing towards the rolling bearing, through said reduction gaps the flow rate of the bearing fluid from the hydrostatic bearing being fed to the rolling bearings.

19. The device according to claim 18, further comprising bearing fluid collection ports arranged between the hydrostatic bearing and the reduction gaps reducing the flow rate of the bearing fluid.

20. The device according to claim 15, wherein, between an outer surface of the stationary shaft and the inner surface of the hollow roller, two annular chambers are formed, which extend between the hydrostatic bearing and the end bearings, said annular chambers being filled with bearing fluid flowing from the hydrostatic bearing.

21. The device according to claim 15, wherein the end bearings are arranged inside toothed wheels mounted on the hollow roller, by which motion is transmitted to the hollow roller.

22. The device according to claim 1, further comprising a cooling system for cooling the bearing fluid.

23. The device according to claim 1, wherein the motor drive is arranged to rotate the hollow roller at a variable speed based upon distance between subsequent transverse cuts.

24. A cutting machine for dividing a continuous web material into sheets, comprising two devices according to claim 1 wherein blades of respective hollow rollers of the two devices co-act to cut the continuous web material.

25. The cutter according to claim 24, wherein the hollow rollers of the two devices are mechanically connected by pairs of gears arranged at the first end and the second end of the hollow rollers.

26. A processing line for processing a web material, comprising a device according to claim 1.

27. A processing line for processing a web material comprising a cutting machine according to claim 24.

28. A processing line for processing a web material comprising a cutting machine according to claim 25.

* * * * *